United States Patent [19]

Huang

[11] Patent Number: 4,517,865

[45] Date of Patent: May 21, 1985

[54] TORQUE-ADJUSTABLE SCREWDRIVER

[76] Inventor: Yung-Lung Huang, 21-1, Kuo Chung Rd., Ta Li Hsiang, Taichung Hsien, Taiwan, 407 R.O.C.

[21] Appl. No.: 568,681

[22] Filed: Jan. 6, 1984

[51] Int. Cl.[3] ..... B25B 23/14

[52] U.S. Cl. ..... 81/475

[58] Field of Search ..... 81/475, 473

[56] References Cited

U.S. PATENT DOCUMENTS 2,797,564 7/1957 Bonneau et al. ..... 81/475

FOREIGN PATENT DOCUMENTS 2427352 12/1975 Fed. Rep. of Germany ..... 81/475

OTHER PUBLICATIONS

IBM Technical Disclosure Bulletin, vol. 24, No. 2, Jul. 1981, p. 1243.

*Primary Examiner*—James L. Jones, Jr.

*Attorney, Agent, or Firm*—Armstrong, Nikaido, Marmelstein & Kubovcik

[57] ABSTRACT

This invention relates a screwdriver capable of exerting a preset twisting force and characterized by comprising a tubular handle, a twisting rod, an adjusting thimble and a spiral spring. The said twisting rod has circular toothing on its projecting part to be engaged with the corresponding toothing on the block serving as a plug in the handle opening. The said spring fitted over the twisting rod between the projecting part of the rod and the projecting part of the adjusting thimble makes the said toothings engaged tightly. The degrees of engagement is used as measurements of twisting force. When the resistance of turning exceeds the preset twisting force the handle will slide on the said toothings and turn idly. This and the sound produced at this moment will remind the operator that the required torque has reached.

3 Claims, 3 Drawing Figures

TORQUE-ADJUSTABLE SCREWDRIVER

BACKGROUND AND SUMMARY OF THE INVENTION

Conventional screwdrivers, electric and hand-operated, have various types but are same in one point that the twisting force exerted on the twisting rod is fixed, i.e. the torque of the twisting rod is set at the factory and within the fixed torque the operator should use the screwdriver empirically. Generally, the screwdriver can function very well but in special cases, it still will make many troubles, such as:

1. When it is used to tighten the screws of precision machinery which requires greater accuracy in connection of parts and has components with moderate hardness and strength, it would impair the designed connection or cause damage to the components if too much pressure is exerted. These are always the case because the operator of a conventional screwdriver can only exert the pressure by experience.

2. In removing screws, the user often does not know the torque required for a tightened screw, or the increased torque for a rusty screw, and can not select a screwdriver with an appropriate end to fit into the slot in the head of the screw to be removed. As a result, it would take more trouble to turn the screw or damage would be caused to the screw or the screwdriver end.

In view of the above mentioned disadvantages, the inventor who has years of experience in making tools of the kind tried to make new designs and improvement, and developed this invention after many tests and experiments. By using the spring-adjusted engagement of the toothings of the twisting rod and the handle block, the twisting force exerted by the twisting rod of the screwdriver of the present invention during screw tightening or loosening can be adjusted and the convenience and application of the screwdriver to precision machinery is greatly increased.

The main object of this invention is to provide a screwdriver with an adjustable engagement of toothings which changes the fixed torque of the conventional screwdriver to a wide range of torque from 5–90 Kgs to meet the need of various torque required in tightening and loosening screws of precision machinery.

Another object of this invention is to provide a screwdriver of which the torque can be set at will in the operation of tightening and loosening screws. If the set torque is exceeded, the twisting rod will slide automatically.

Still another objective of this invention is to provide a screwdriver of which the torque can be set within a wide range for a variety of applications in precision operation.

A further object of this invention is to provide a screwdriver which will not cause damage to the screw, working piece or the end of the screwdriver itself when it is used to turn screws.

DETAILED DESCRIPTION

Figure 1:
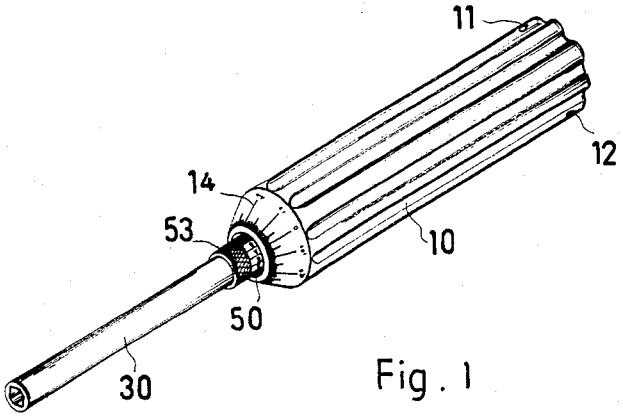
FIG. 1 is a vertical view of the torque-adjustable screwdriver of this invention.
Figure 2:
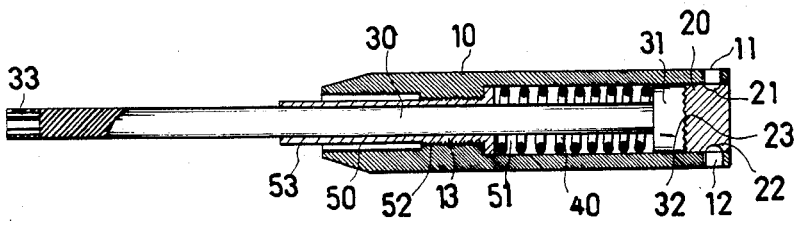
FIG. 2 is a section of the torque-adjustable screwdriver of this invention.
Figure 3:
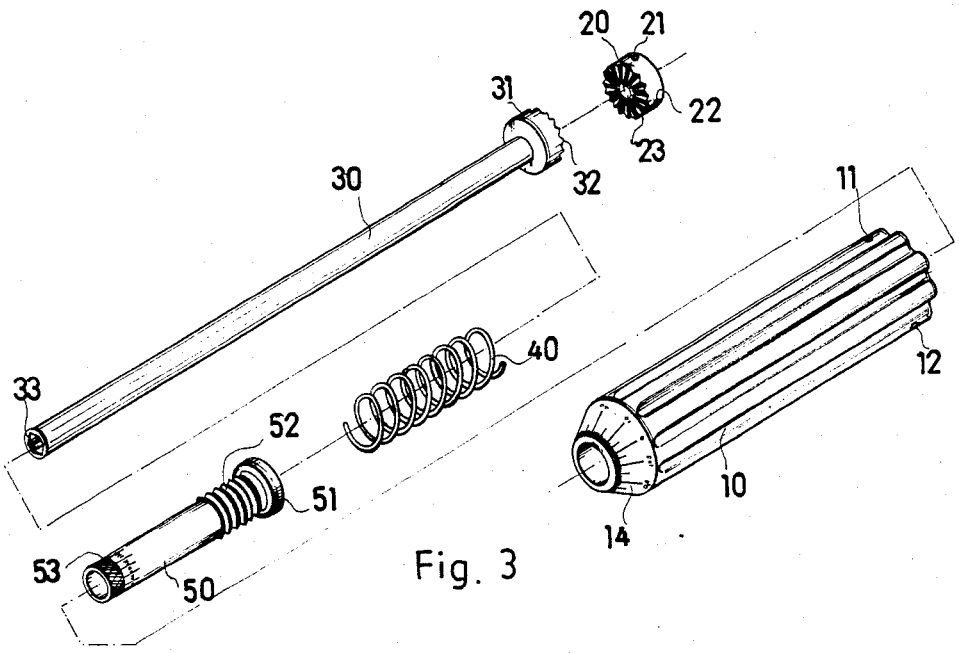
FIG. 3 is a perspective sectional view of the torque-adjustable screwdriver of this invention.

Referring now to the drawings the construction of the torque-adjustable screwdriver of this invention is described as follows:

As shown in FIGS. 1–3, the tubular handle 10 has two opposite screw holes 11 and 12 in its rear end sides for fixing the block 20 which has two corresponding screw holes 21 and 22 and which serves as a plug of the tubular handle 10. The twisting rod 30 has a projection part 31 of which the top with circular toothing 32 keeps in mesh with the similar toothing 23 of the block 20. For adjusting thimble 50 fitted over the twisting rod 30 and has a threaded part 52 keeping in mesh with the threaded inside of the tubular handle 10 and also has at its rear end a projecting part 51 in the same diameter as those of the twisting rod projecting part 31 and the block 20. The spiral spring 40 fitted over the twisting rod 30 between the rod projecting part 31 and the thimble projecting part 51 exerts considerable pressure to make the toothings 32 and 23 of the rod projecting part 31 and the block 20 engaged tightly. The tightness of engagement can be adjusted by means of the adjusting thimble 50. The tightness reduces with the advance of the adjusting thimble 50 and vice versa. When the chisel-like end inserted in the hole 33 in the end of the twisting rod 30 fits into the slot in the head of a screw and the handle 10 of the screwdriver is turned, the twisting rod 30 will be turned together with the handle 10 because its toothing 32 is in mesh with the toothing 23 of the handle block 20, and a twisting force will exert on the screw (not shown) being tightened. But when the screw is tightened to a certain degree that the resistance of turning exceeds the force of engagement, the twisting rod 30 will not be turned with the handle 10 but allow the handle 10 to slide on its toothing 32 and to turn idly. At this time, the operator will know the screw has been tightened to a particular torque. Based on such degrees for measuring, marks are made on the exposed end 53 of the adjusting thimble 50 and on the front end 14 of the handle 10. With this scale, the user can set the graduated thimble 50 to a correct torque value before starting to turn screws and correctly and quickly finish the operation of screw turning.

When the screwdriver is used to loosen screws, the user may set the graduated thimble to the normal torque value of the screwdriver end or the screw. If the screw is too tight, the handle 10 will turn idly and the operator knowing this will take necessary steps to loosen the screw without causing damage to the screw or the screwdriver end.

The torque of the twisting rod 30 of this invention may be adjusted in a wide range of 5–90 Kgs so as to meet the need of turning various screws.

Accordingly, the screwdriver of which the twisting rod can be adjusted in a wide torque range to meet the need of various screws and to ensure safe operation is really a new and practical invention.

I claim:

1. a torque-adjustable screwdriver comprising:

A tubular handle having two screw holes at its rear end for screws to fix a block serving as a plug and having graduation at its front end as measurements of the torque of its twisting rod and an intermediate internal thread portion;

a block having two screw holes for fixing itself in the rear end of the handle and having circular toothing on its front end;

a twisting rod having a hole in its front end for holding the chisel-like end of the screwdriver and having a projecting part at its rear end which has circular toothing corresponding to that of the block;

an adjusting thimble between the tubular handle and twisting rod having a radial projecting part at its rear end and having a threaded part in front of the projecting part, which keeps in mesh with the internal thread portion of the tubular handle and which makes the twisting rod go back and forth when it is turned by hand on an exposed front part;

a spiral spring fitted over the twisting rod and between the projecting parts of the adjusting thimble and the twisting rod to exert pressure on the twisting rod.

2. A screwdriver according to claim 1 wherein the circular toothing on the top of the twisting rod corresponds to the circular toothing on the handle block and engages with the same tightly under the pressure of the spring.

3. A screwdriver according to claim 1 wherein the spring between the projecting parts of the twisting rod and the adjusting thimble exerts different pressure on the twisting rod with the movement of the adjusting thimble and in turn the circular toothing of twisting rod engages with that of the handle block in different tightness so that the twisting force can be adjusted in a wide range.

* * * * *